US009795850B1

(12) United States Patent
Sancier

(10) Patent No.: US 9,795,850 B1
(45) Date of Patent: Oct. 24, 2017

(54) BALL STRIKING TRAINING DEVICE

(71) Applicant: Gregory Sancier, Campbell, CA (US)

(72) Inventor: Gregory Sancier, Campbell, CA (US)

( * ) Notice: Subject to any disclaimer, the term of this patent is extended or adjusted under 35 U.S.C. 154(b) by 0 days.

(21) Appl. No.: 15/225,399

(22) Filed: Aug. 1, 2016

(51) Int. Cl.
*A63B 69/00* (2006.01)
*A63B 59/00* (2015.01)
*A63B 59/58* (2015.01)

(52) U.S. Cl.
CPC ..... *A63B 69/0002* (2013.01); *A63B 59/58* (2015.10); *A63B 59/00* (2013.01); *A63B 2069/0008* (2013.01)

(58) Field of Classification Search
CPC ..... A63B 59/50; A63B 60/54; A63B 69/0002
USPC ..... 473/457, 437, 422, 451, 564, 453
See application file for complete search history.

(56) References Cited

U.S. PATENT DOCUMENTS 805,132 A * 11/1905 Gubbins ..... A63B 60/48 473/564
1,325,813 A * 12/1919 Taylor, Jr. ..... A63B 59/50 473/564
3,623,724 A * 11/1971 Lande ..... A63B 59/50 473/437
5,273,278 A * 12/1993 Becker ..... A63B 49/02 473/457
D357,289 S 4/1995 Cramton
5,676,609 A * 10/1997 Møllebaek ..... A63B 59/50 473/564
D397,385 S 8/1998 LaBorde et al.
6,565,462 B1 5/2003 Gregg
7,985,147 B1 7/2011 Allen
8,282,510 B1 * 10/2012 Englund ..... A63B 59/50 473/422
8,641,560 B2 2/2014 Vignola
2007/0219027 A1 * 9/2007 Chong ..... A63B 60/54 473/564
2008/0234075 A1 * 9/2008 Lancisi ..... A63B 59/50 473/457
2009/0181812 A1 * 7/2009 Miller ..... A63B 69/0002 473/453
2009/0325736 A1 12/2009 Carsello
2011/0250994 A1 * 10/2011 Budzielek ..... A63B 69/0002 473/457
2012/0172157 A1 * 7/2012 McCrory ..... A63B 69/0002 473/457
2013/0184106 A1 * 7/2013 McCrory ..... A63B 69/0002 473/457

FOREIGN PATENT DOCUMENTS

WO WO2009111797 9/2009

* cited by examiner

*Primary Examiner* — Mitra Aryanpour

(57) ABSTRACT

A ball striking training device for training a user to strike a ball includes a bat. A recess is positioned in a front of the bat distal from a handle of the bat. A plurality of inserts is selectively couplable to the bat within the recess. A respective insert is positionable within the recess with a front face of the respective insert positioned proximate to the front of the bat. Each insert is selectively couplable to the bat such that a respective front face of the insert is positioned proximate to the front of the bat. The handle is configured to be grasped in the hands of a user, such that the insert is configured to strike a ball with the respective front face of the insert.

11 Claims, 3 Drawing Sheets

BALL STRIKING TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to training devices and more particularly pertains to a new training device for training a user to strike a ball.

BRIEF SUMMARY OF THE INVENTION

An embodiment of the disclosure meets the needs presented above by generally comprising a bat. A recess is positioned in a front of the bat distal from a handle of the bat. A plurality of inserts is selectively couplable to the bat within the recess. A respective insert is positionable within the recess with a front face of the respective insert positioned proximate to the front of the bat. Each insert is selectively couplable to the bat such that a respective front face of the insert is positioned proximate to the front of the bat. The handle is configured to be grasped in the hands of a user, such that the insert is configured to strike a ball with the respective front face of the insert.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
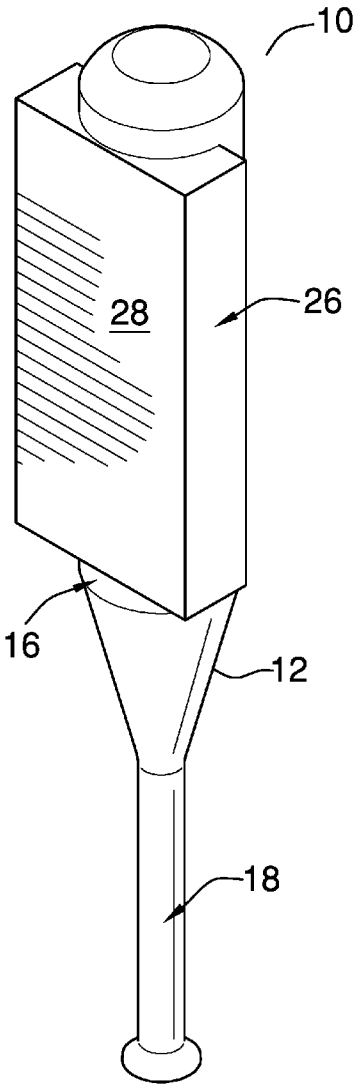
FIG. 1 is an isometric perspective view of a ball striking training device according to an embodiment of the disclosure.
Figure 2:
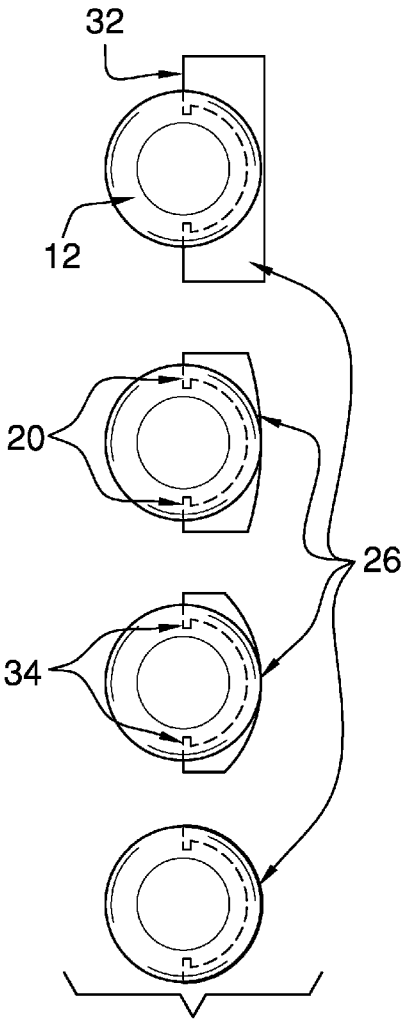
FIG. 2 is a longitudinal view of an embodiment of the disclosure.
Figure 3:
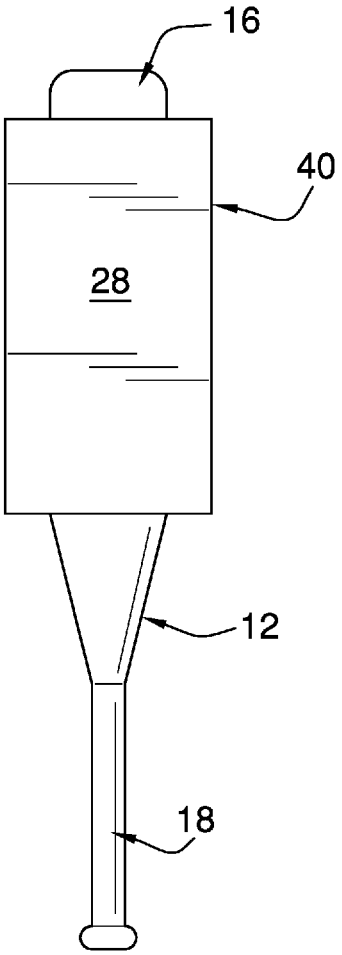
FIG. 3 is a front view of an embodiment of the disclosure.
Figure 4:
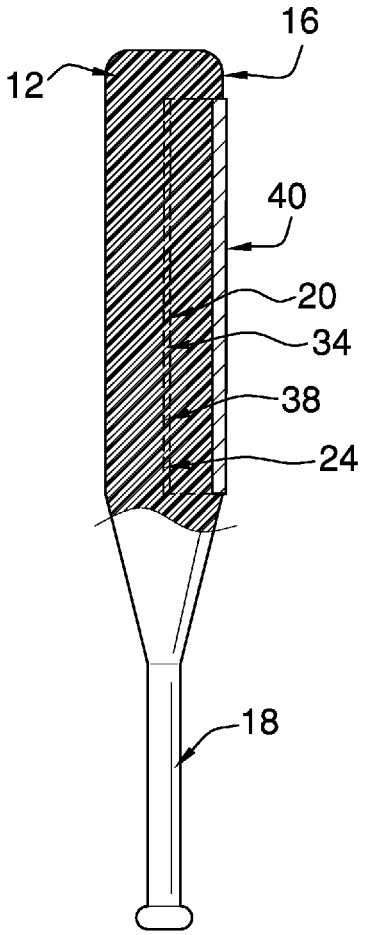
FIG. 4 is a side view of an embodiment of the disclosure.
Figure 5:
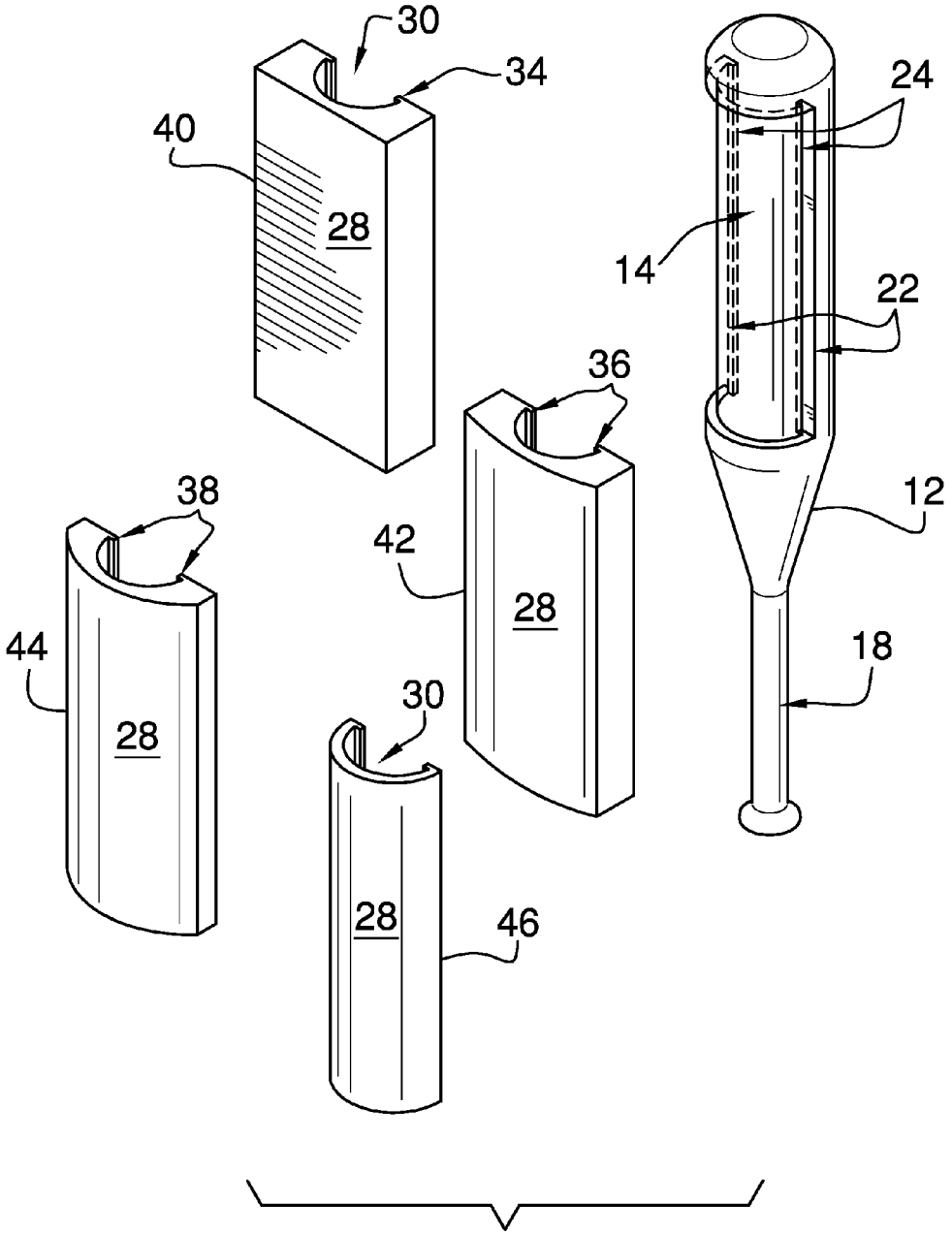
FIG. 5 is an exploded view of an embodiment of the disclosure.

With reference now to the drawings, and in particular to FIGS. 1 through 5 thereof, a new training device embodying the principles and concepts of an embodiment of the disclosure and generally designated by the reference numeral 10 will be described.

As best illustrated in FIGS. 1 through 5, the ball striking training device 10 generally comprises a bat 12. A recess 14 is positioned in a front 16 of the bat 12 distal from a handle 18 of the bat 12.

A plurality of first fasteners 20 is coupled to the bat 12. The first fasteners 20 are positioned along opposing edges 22 of the recess 14. In one embodiment, the plurality of first fasteners 20 comprises a pair of grooves 24. Each groove 24 extends into the bat 12 along a respective opposing edge 22 of the recess 14.

The device 10 comprises a plurality of inserts 26 that is selectively couplable to the bat 12 within the recess 14. A respective insert 26 is positionable within the recess 14 with a front face 28 of the respective insert 26 positioned proximate to the front 16 of the bat 12. In one embodiment, the inserts 26 are resilient.

Each insert 26 comprises a channel 30 that is positioned in a back face 32 of the insert. The channel 30 is complementary to the recess 14. A plurality of second fasteners 34, complementary to the first fasteners 20, is positioned on the insert 26 along opposing sides 36 of the channel 30. The second fasteners 34 are positioned on a respective insert 26 such that the second fasteners 34 are positioned to couple to the first fasteners 20 to couple the respective insert 26 to the bat 12.

In one embodiment, the plurality of second fasteners 34 of each insert 26 comprises a pair of tongues 38. The tongues 38 are complementary to the grooves 24. Each tongue 38 is coupled to and extends from a respective opposing side 36 of the channel 30. The insert 26 is deformable such that respective tongues 38 of the insert 26 are insertable into the grooves 24 of the bat 12, such that the insert 26 is reversibly couplable to the bat 12.

In one embodiment, the plurality of inserts 26 comprises a first inlay 40. The front face 28 of the first inlay 40 is flat. In another embodiment, the first inlay 40 is dimensionally wider than the bat 12.

In one embodiment, the plurality of inserts 26 comprises a second inlay 42. The front face 28 of the second inlay 42 is arcuate. In another embodiment, the second inlay 42 is dimensionally wider than the bat 12.

In one embodiment, the plurality of inserts 26 comprises a third inlay 44. The front face 28 of the third inlay 44 is more arcuate than the front face 28 of the second inlay 42. In another embodiment, the third inlay 44 is dimensionally wider than the bat 12.

In one embodiment, the plurality of inserts 26 comprises a fourth inlay 46. The front face 28 of the fourth inlay 46 is more arcuate than the front face 28 of the third inlay 44. The bat 12 is circular when viewed longitudinally with the fourth inlay 46 positioned in the recess 14.

In use, each insert 26 is selectively couplable to the bat 12 such that a respective front face 28 of the insert 26 is positioned proximate to the front 16 of the bat 12. The handle 18 is configured to be grasped in the hands of a user. The insert 26 is configured to strike a ball with the respective front face 28 of the insert 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ball striking training device comprising:

a bat;

a recess positioned in a front of said bat distal from a handle of said bat;

a plurality of inserts selectively couplable to said bat within said recess, such that a respective said insert is positionable within said recess with a front face of said respective said insert positioned proximate to said front of said bat;

wherein each said insert is selectively couplable to said bat such that a respective said front face of said insert is positioned proximate to said front of said bat, wherein said handle is configured for grasping in the hands of a user, wherein said insert is configured to strike a ball with said respective said front face of said insert;

a plurality of first fasteners coupled to said bat, said first fasteners being positioned along opposing edges of said recess;

each said insert comprising:

a channel positioned in a back face of said insert, said channel being complementary to said recess, and a plurality of second fasteners, said second fasteners being complementary to said first fasteners, said second fasteners being positioned on said insert along opposing sides of said channel; and wherein said second fasteners are positioned on a respective said insert such that said second fasteners are positioned to couple to said first fasteners to couple said respective said insert to said bat.

2. The device of claim 1, further including said inserts being resilient.

3. A ball striking training device comprising:

a bat;

a recess positioned in a front of said bat distal from a handle of said bat;

a plurality of inserts selectively couplable to said bat within said recess, such that a respective said insert is positionable within said recess with a front face of said respective said insert positioned proximate to said front of said bat, said inserts being resilient;

wherein each said insert is selectively couplable to said bat such that a respective said front face of said insert is positioned proximate to said front of said bat, wherein said handle is configured for grasping in the hands of a user, wherein said insert is configured to strike a ball with said respective said front face of said insert;

a plurality of first fasteners comprising a pair of grooves, each said groove extending into said bat along a respective said opposing edge of said recess;

a plurality of second fasteners of each said insert comprising a pair of tongues, said tongues being complementary to said grooves, each said tongue being coupled to and extending from a respective said opposing side of said channel; and wherein each said insert is deformable such that respective said tongues of said insert are insertable into said grooves of said bat such that said insert is reversibly couplable to said bat.

4. A ball striking training device comprising:

a bat;

a recess positioned in a front of said bat distal from a handle of said bat;

a plurality of inserts selectively couplable to said bat within said recess, such that a respective said insert is positionable within said recess with a front face of said respective said insert positioned proximate to said front of said bat;

wherein each said insert is selectively couplable to said bat such that a respective said front face of said insert is positioned proximate to said front of said bat, wherein said handle is configured for grasping in the hands of a user, wherein said insert is configured to strike a ball with said respective said front face of said insert, said plurality of inserts comprising a first inlay, wherein said front face of said first inlay is flat.

5. The device of claim 4, further including said first inlay being dimensionally wider than said bat.

6. The device of claim 4, further including said plurality of inserts comprising a second inlay, wherein said front face of said second inlay is arcuate.

7. The device of claim 6, further including said second inlay being dimensionally wider than said bat.

8. The device of claim 6, further including said plurality of inserts comprising a third inlay, wherein said front face of said third inlay is more arcuate than said front face of said second inlay.

9. The device of claim 8, further including said third inlay being dimensionally wider than said bat.

10. The device of claim 8, further including said plurality of inserts comprising a fourth inlay, wherein said front face of said fourth inlay is more arcuate than said front face of said third inlay, such that said bat is circular when viewed longitudinally with said fourth inlay positioned in said recess.

11. A ball striking training device comprising:

a bat;

a recess positioned in a front of said bat distal from a handle of said bat;

a plurality of first fasteners coupled to said bat, said first fasteners being positioned along opposing edges of said recess, said plurality of first fasteners comprising a pair of grooves, each said groove extending into said bat along a respective said opposing edge of said recess;

a plurality of inserts selectively couplable to said bat within said recess, such that a respective said insert is positionable within said recess with a front face of said respective said insert positioned proximate to said front of said bat, said inserts being resilient, each said insert comprising:

a channel positioned in a back face of said insert, said channel being complementary to said recess, a plurality of second fasteners, said second fasteners being complementary to said first fasteners, said second fasteners being positioned on said insert along opposing sides of said channel, said plurality of second fasteners of each said insert comprising a pair of tongues, said tongues being complementary to said grooves, each said tongue being coupled to and extending from a respective said opposing side of said channel, and wherein said second fasteners are positioned on a respective said insert such that said second fasteners are positioned to couple to said first fasteners to couple said respective said insert to said bat, wherein each said insert is deformable such that respective said tongues of said insert are insertable into said grooves of said bat such that said insert is reversibly couplable to said bat;

said plurality of inserts comprising:

a first inlay, wherein said front face of said first inlay is flat, said first inlay being dimensionally wider than said bat, a second inlay, wherein said front face of said second inlay is arcuate, said second inlay being dimensionally wider than said bat, a third inlay, wherein said front face of said third inlay is more arcuate than said front face of said second inlay, said third inlay being dimensionally wider than said bat, and a fourth inlay, wherein said front face of said fourth inlay is more arcuate than said front face of said third inlay, such that said bat is circular when viewed longitudinally with said fourth inlay positioned in said recess; and wherein each said insert is selectively couplable to said bat such that a respective said front face of said insert is positioned proximate to said front of said bat, wherein said handle is configured for grasping in the hands of a user, wherein said insert is configured to strike a ball with said respective said front face of said insert.

* * * * *